US011353012B2

(12) United States Patent
Sun et al.

(10) Patent No.: US 11,353,012 B2
(45) Date of Patent: Jun. 7, 2022

(54) APPARATUS TO PREVENT SIDE LOAD IN HYDRAULIC OVERRIDE PUMPS

(71) Applicant: Emerson Process Management, Valve Automation, Inc., Houston, TX (US)

(72) Inventors: Joseph Sun, Katy, TX (US); Matt Christopherson, Richmond, TX (US); Edwin Schreuder, Enschede (NL)

(73) Assignee: Emerson Process Management, Valve Automation, Inc., Houston, TX (US)

( * ) Notice: Subject to any disclaimer, the term of this patent is extended or adjusted under 35 U.S.C. 154(b) by 196 days.

(21) Appl. No.: 16/146,641

(22) Filed: Sep. 28, 2018

(65) Prior Publication Data

US 2020/0102941 A1 Apr. 2, 2020

(51) Int. Cl.

| | |
|---|---|
| ***F04B 19/02*** | (2006.01) |
| ***F04B 9/14*** | (2006.01) |
| ***F04B 53/10*** | (2006.01) |
| ***F04B 33/00*** | (2006.01) |
| *F04B 19/22* | (2006.01) |
| *F04B 23/02* | (2006.01) |
| *F04B 53/16* | (2006.01) |
| *F04B 9/02* | (2006.01) |

(52) U.S. Cl.

CPC ..... *F04B 19/027* (2013.01); *F04B 9/14* (2013.01); *F04B 33/00* (2013.01); *F04B 53/10* (2013.01); *F04B 9/025* (2013.01); *F04B 19/22* (2013.01); *F04B 23/025* (2013.01); *F04B 53/16* (2013.01); *F04B 2201/08* (2013.01)

(58) Field of Classification Search

CPC ..... F04B 19/027; F04B 2201/08; F04B 2201/124; F04B 19/02; F04B 23/025; F04B 9/025

See application file for complete search history.

(56) References Cited

U.S. PATENT DOCUMENTS 2,301,130 A * 11/1942 Delaney ..... F04B 19/027 184/27.4
2,510,972 A 6/1950 Gray
3,006,281 A * 10/1961 John ..... B66F 3/42 417/285

(Continued)

FOREIGN PATENT DOCUMENTS

FR 875779 A 10/1942

OTHER PUBLICATIONS

International Searching Authority, "International Search Report," dated Nov. 29, 2019 in connection with International Patent Application No. PCT/US2019/052817, 5 pages.

(Continued)

*Primary Examiner* — Nathan C Zollinger
*Assistant Examiner* — Timothy P Solak
(74) *Attorney, Agent, or Firm* — Hanley, Flight & Zimmerman, LLC

(57) ABSTRACT

An example apparatus to prevent side load in hydraulic override pumps includes a lever rotatably mounted to a support. The apparatus includes a pump cylinder rotatable about a first end of the pump cylinder. The apparatus also includes a pump rod operatively coupled to the lever to move within the pump cylinder based on rotation of the lever. The pump cylinder rotates when the pump rod moves within the pump cylinder.

20 Claims, 5 Drawing Sheets

(56) References Cited

U.S. PATENT DOCUMENTS

| | | | | | |
|---|---|---|---|---|---|
| 3,098,587 | A * | 7/1963 | Hopfeld | B66F 3/42 | 222/628 |
| 3,539,278 | A * | 11/1970 | Chester | F04B 53/00 | 417/465 |
| 3,816,028 | A * | 6/1974 | Schouteeten | F04B 19/027 | 417/214 |
| 4,720,246 | A * | 1/1988 | Morton | F04F 1/06 | 417/139 |
| 5,221,195 | A * | 6/1993 | Beelen | F04B 9/14 | 417/461 |
| 2008/0039300 | A1 * | 2/2008 | Fisher | F04B 53/105 | 482/112 |

OTHER PUBLICATIONS

International Searching Authority, "Written Opinion," dated Nov. 29, 2019 in connection with International Patent Application No. PCT/US2019/052817, 8 pages.

* cited by examiner

APPARATUS TO PREVENT SIDE LOAD IN HYDRAULIC OVERRIDE PUMPS

FIELD OF THE DISCLOSURE

This disclosure relates generally to hydraulic pumps and, more particularly, to apparatus to prevent side load in hydraulic override pumps.

BACKGROUND

Actuators automate control valves by providing a force and/or torque that causes motion and/or rotation to open or close a valve. In operation, a controller may cause an actuator to position a valve stem or shaft and, thus, a flow control member to a desired position to regulate fluid flowing through a valve. Hydraulic override pumps can be used in process control systems to override automatic control of valves or other devices in the process control system. An operator can operate the hydraulic override pump to drive a hydraulic cylinder to manually pump fluid (e.g., through a valve). During emergency situations, power failures, or if air supply to a pneumatic actuator is shut down, for example, it may be necessary to manually override the position of the flow control member of a valve to a predetermined position (e.g., a closed position).

Figure 1:
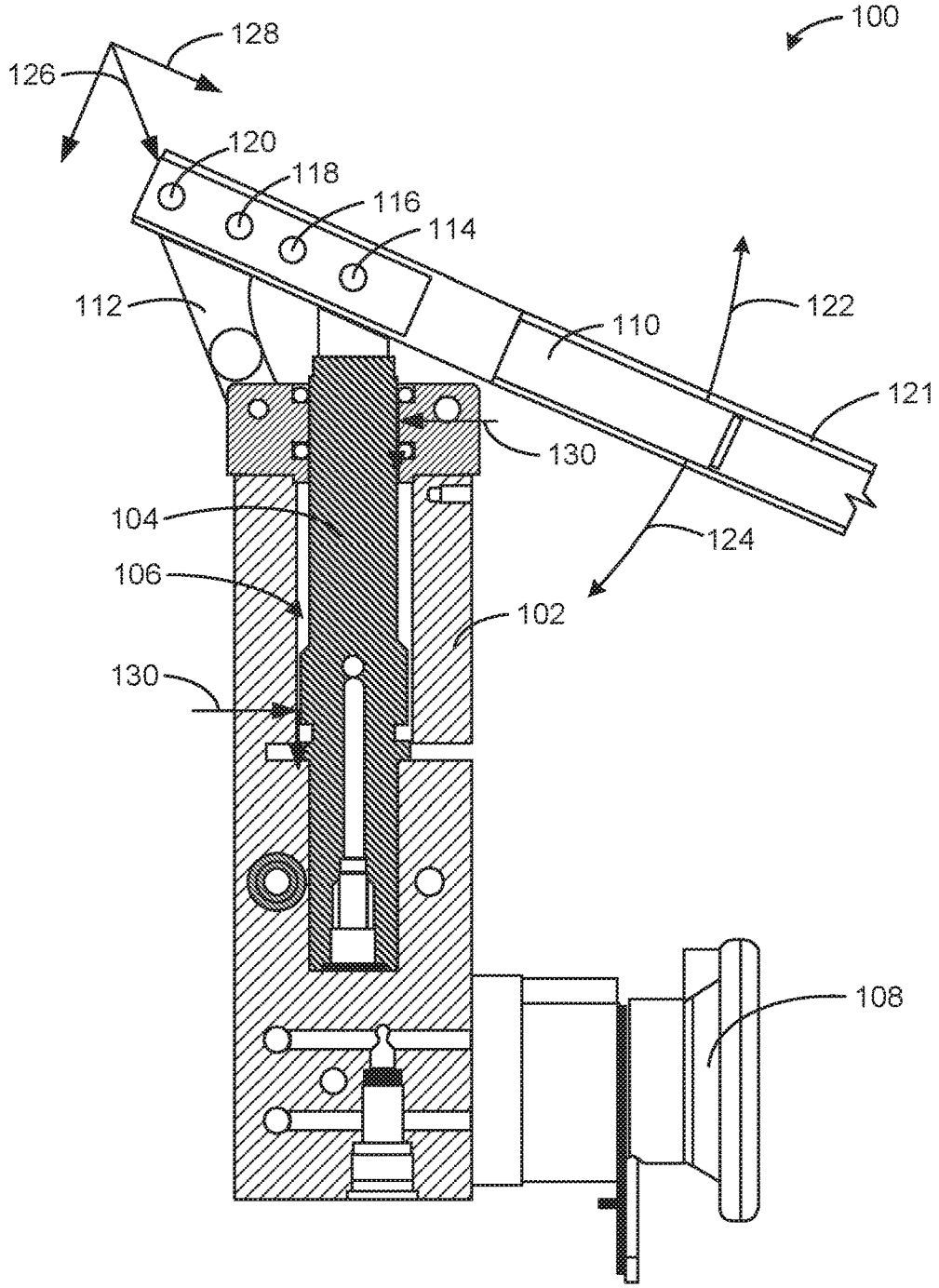
FIG. 1 (Prior Art)
FIG. 1 is a cross-sectional view of a known hydraulic manual override pump.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part means that there is no intermediate part between the two parts.

SUMMARY

An example apparatus includes a lever rotatably mounted to a support, a pump cylinder rotatable about a first end of the pump cylinder, and a pump rod operatively coupled to the lever to move within the pump cylinder based on rotation of the lever, wherein the pump cylinder rotates when the pump rod moves within the pump cylinder.

An example apparatus includes a pump cylinder rotatable about its first end and a pump rod operatively coupled to the pump cylinder to move relative to the pump cylinder in response to movement of a lever. The apparatus further includes a pivot pin operatively coupled to the first end of the pump cylinder to allow rotation of the pump cylinder during movement of the pump rod.

DETAILED DESCRIPTION

Actuators automate control valves by providing a force and/or torque that causes motion and/or rotation to open or close a valve. In operation, a controller may cause an actuator to position a valve stem or shaft and, thus, a flow control member to a desired position to regulate fluid flowing through a valve. When the valve is closed, the flow control member is typically configured to engage an annular or circumferential seal that encircles the flow path through the valve to prevent the flow of fluid (e.g., in one or both directions) through the valve.

During emergency situations, power failures, and/or if air supply to a pneumatic actuator is shut down, for example, it may be necessary to manually override the position of the flow control member of a valve to a predetermined position (e.g., a closed position). For example, manual override mechanisms for control valves permit manual operation of a valve and do not require an outside power source to move the flow control member of the valve to a desired position. Instead, known manual override mechanisms typically use a hand wheel, a chain wheel, a lever, a declutchable mechanism, or a combination thereof, to drive a series of gears (e.g., a worm drive gearbox, etc.) providing a reduction that results in a higher output torque compared to an input (manual) torque provided by a person.

Further, hydraulic override pumps can be used in process control systems to override automatic control of valves or other devices in the process control system. The hydraulic override pumps can be manual pumps used by an operator to drive a hydraulic cylinder to manually pump fluid (e.g., through a valve). Some known hydraulic override pumps include a fixed pump cylinder and a pump rod that moves within the pump cylinder. The pump rod of the known hydraulic override pumps is rotatably coupled to a lever to allow an operator to move the pump rod by rotating the lever. However, as the lever is rotated, a side load (e.g., a force acting between the pump rod and the pump cylinder) is applied to the pump cylinder by the pump rod. The amount of side load on the pump cylinder is proportional to the pressure needed in a specific application. For example, if the pressure required for a given application is high (e.g., 3000 psi), the force exerted on the lever is also high, and the side load exerts a load on the pump cylinder that is proportional to this force.

The side load that is created when using the above-noted known hydraulic override pumps increases friction between the pump rod and the pump cylinder, reducing the efficiency of the hydraulic override pump. Further, the side load and resulting friction increase wear on the hydraulic override pump, causing a decrease in the lifespan of the pump.

The examples disclosed herein include a hydraulic override pump that reduces friction between the pump rod and the pump cylinder by eliminating a side load between the pump rod and the pump cylinder. For example, the apparatus disclosed herein allow rotation of the pump cylinder to accommodate changes in an angle of the pump rod (e.g., an angle relative to a vertical plane) when the hydraulic override pump is in use (e.g., due to rotation of a lever to which the pump rod is coupled). Because the pump cylinder rotates, the force exerted on the pump rod by the lever is maintained along a central axis of the pump cylinder. Further, examples disclosed herein include a pivot pin located at an end of the pump cylinder about which the pump cylinder rotates during operation of the hydraulic override pump. The pivot pin facilitates a fluid connection between the hydraulic pump and a manifold used for fluid communication between the hydraulic pump and a fluid reservoir and/or a fluid control valve.

FIG. 1 is a cross-sectional view of a known hydraulic manual override pump 100. The known hydraulic manual override pump 100 includes a pump cylinder 102 and a pump rod 104. In operation, the pump rod 104 moves within the pump cylinder 102 (e.g., up or down in the orientation of FIG. 1) to pull fluid into or push fluid out of a chamber 106. The chamber 106 is a cavity within the pump cylinder 102 in which the pump rod 104 is disposed. As the pump rod 104 moves up (e.g., in the orientation of FIG. 1), fluid is pulled into the chamber 106. When the pump rod 104 is pushed back into the chamber 106, the fluid exits the chamber 106 and flows to a fluid control valve 108.

The pump rod 104 moves within the pump cylinder 102 in response to manual actuation by a lever 110. The lever 110 is rotatably mounted to a rocker 112, also referred to as a swing arm, and the lever 110 rotates about the rocker 112. The rocker 112 is further rotatably coupled to the pump cylinder 102. The lever 110 includes a first joint 114, a second joint 116, a third joint 118, and a fourth joint 120. In FIG. 1, the pump rod 104 is rotatably coupled to the lever 110 at the first joint 114. Further, the rocker 112 is rotatably coupled to the lever 110 at the fourth joint 120. The rocker 112 can also be rotatably coupled to the second joint 116 or the third joint 118 of the lever 110.

In operation, an operator applies a force to an example pump handle 121 (e.g., at an end opposite the rocker 112) to rotate the lever 110 in a first direction 122 or a second direction 124. When the lever 110 is rotated in the first direction 122 (e.g., counterclockwise in the orientation of FIG. 1), the pump rod 104 is moved upward (e.g., in the orientation of FIG. 1) and away from the pump cylinder 102. The movement of the pump rod 104 away from the pump cylinder 102 creates additional volume in the chamber 106, and fluid flows into the chamber 106. When the lever 110 is rotated in the second direction (e.g., clockwise in the orientation of FIG. 1), the pump rod 104 moves toward the pump cylinder 102 (e.g., downward in the orientation of FIG. 1). Movement of the pump rod 104 toward the pump cylinder 102 decreases the volume in the chamber 106, and fluid is expelled from the chamber 106 due to the pressure created in the chamber 106 by movement of the pump rod 104. The fluid can enter the chamber 106 from a reservoir (not shown) when the lever is rotated in the first direction 122 and can be pushed from the chamber 106 to the fluid control valve 108 when the lever 110 is rotated in the second direction 124.

As the lever 110 is rotated in the first direction 122 or the second direction 124 (e.g., by an operator rotating the pump handle 121), the rocker 112 rotates about the pump cylinder 102. A force 126 is applied at the fourth joint 120 (e.g., the joint connecting the rocker 112 and the lever 110) when the lever 110 is rotated. When the rocker 112 is vertical in the orientation of FIG. 1, the force 126 is exerted in the vertical direction, and there is no horizontal component of the force 126 (e.g., the force 126 is exerted vertically into the pump cylinder 102 only). However, if the rocker 112 is at an angle relative to the pump cylinder 102 (e.g., an angle relative to a vertical plane in the orientation of FIG. 1), as is shown in FIG. 1, the force 126 is exerted at an angle in a direction along the rocker 112.

When the force 126 is not exerted in the vertical direction, there exists a force component 128 in a direction along the lever 110. The force component 128 causes a side load 130 to be applied between the pump rod 104 and the pump cylinder 102. For example, the force component 128 urges an end of the pump rod 104 proximate the first joint 114 to the right (e.g., in the orientation of FIG. 1) and an end of the pump rod 104 opposite the first joint 114 to the left (e.g., in the orientation of FIG. 1). The force component 128 therefore causes the pump rod 104 to be misaligned with the pump cylinder 102 and the pump cylinder 102 exerts the side load 130 on the pump rod 104. The side load 130 creates friction between the pump rod 104 and the pump cylinder 102 during movement of the pump rod 104 relative to the pump cylinder 102. The friction caused by the side load 130 reduces the efficiency of the hydraulic manual override pump 100 (e.g., more force is required to rotate the lever 110 because the frictional forces must be overcome). Further, the side load 130 and accompanying friction increase wear on the known hydraulic manual override pump 100, reducing the lifespan of the known hydraulic manual override pump 100.

Figure 2:
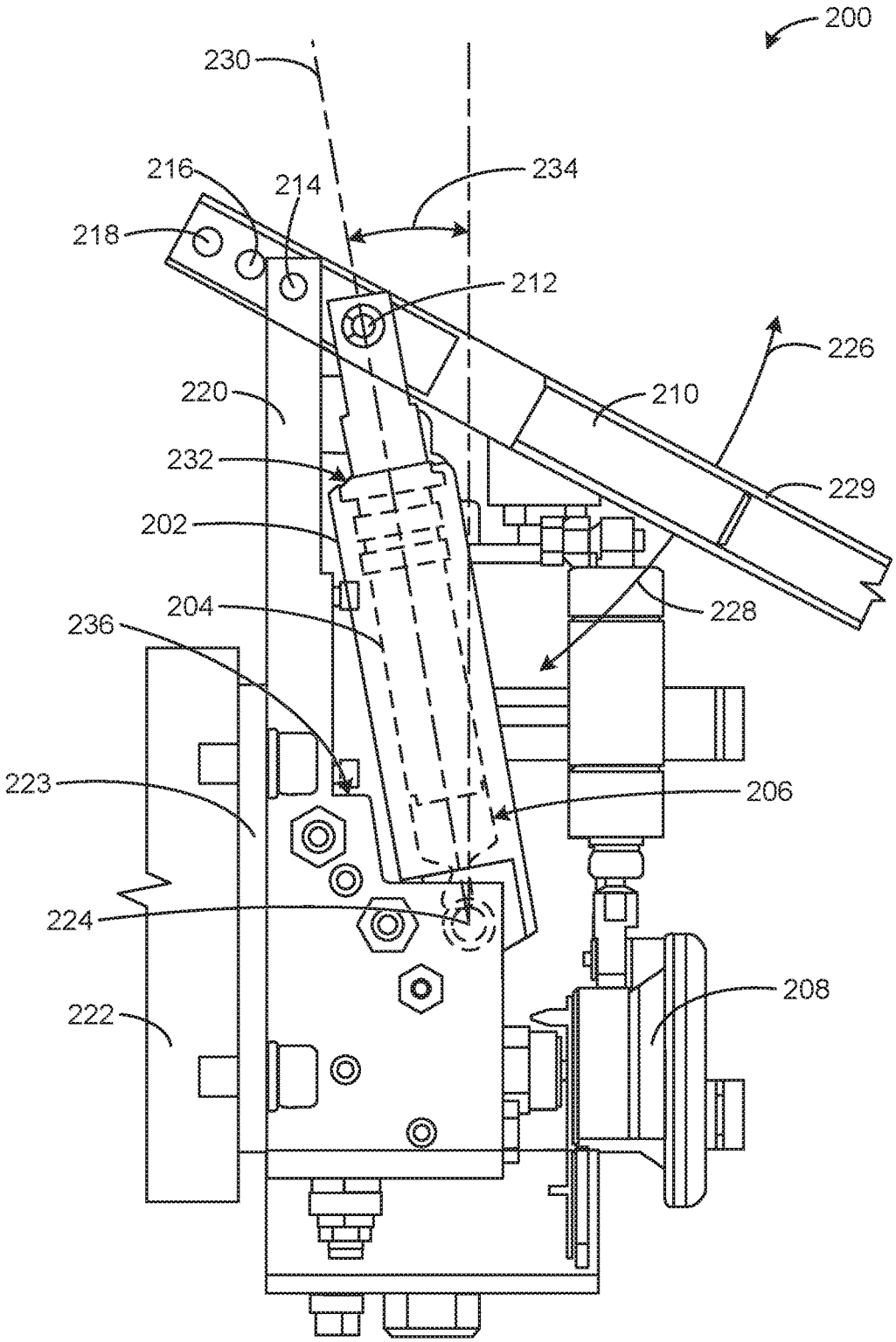
FIG. 2 is a front view of an example hydraulic manual override pump in a first configuration and including a rotatable pump cylinder.

FIG. 2 is a front view of an example hydraulic manual override pump 200 in a first configuration and including a rotatable pump cylinder. In the illustrated example, the hydraulic manual override pump 200 includes a pump cylinder 202 and a pump rod 204. In operation, the pump rod 204 moves within the pump cylinder 202 to pull fluid into or push fluid out of an example chamber 206. The chamber 206 is a cavity within the pump cylinder 202 within which the pump rod 204 is disposed. As the pump rod 204 moves up (e.g., in the orientation of FIG. 2), backpressure is created in the chamber 206, and fluid is pulled into the chamber 206. When the pump rod 204 moves back into the chamber 206 (e.g., toward the pump cylinder 202), the fluid exits the chamber 206 into an example fluid control valve 208.

In the illustrated example, a lever 210 rotates to move the pump rod 204 within the pump cylinder 202. The lever 210 of the illustrated example includes a first joint 212, a second joint 214, a third joint 216, and a fourth joint 218. In the illustrated example, the hydraulic manual override pump 200 is in a first configuration, where the pump rod 204 is rotatably coupled to the lever 210 at the first joint 212. Further, the lever 210 is rotatably coupled to an example support 220 at the second joint 214. Alternatively, in some examples, the lever 210 is rotatably mounted to the support 220 at the third joint 216 or the fourth joint 218. In some examples, the lever 210 is rotatably coupled to the support 220 at a variable position along the lever 210 (e.g., the lever 210 is movable between the second joint 214, the third joint 216, and the fourth joint 218). In some examples, the support 220 is a back brace. In some examples, the support 220 is fixed to an example housing 222 via an example mounting bracket 223. The housing 222 provides structure to and protects components of the hydraulic manual override pump 200.

The illustrated example of FIG. 2 does not include a rocker or swing arm, such as the rocker 112 of FIG. 1. Instead, the hydraulic manual override pump 200 includes an example pivot pin 224 about which the pump cylinder 202 rotates when the lever 210 rotates in an example first direction 226 and/or an example second direction 228. In some examples, the pivot pin 224 is operatively coupled to the pump cylinder 202 at an end of the pump cylinder 202 (e.g., an end about which the pump cylinder 202 rotates). In operation, the lever 210 of the illustrated example is rotated (e.g., by an operator exerting a force on the lever 210) about the second joint 214. In the illustrated example, the lever 210 rotates when an operator rotates a pump handle 229. In some examples, the pump handle 229 is removably coupled to the lever 210 (e.g., slidably engages the lever 210) to create a longer lever arm (e.g., longer than a lever arm of the lever 210). In such examples, the pump handle 229 increases an input force that an operator can exert on the pump rod 204 by increasing the length of the lever arm.

When the lever 210 rotates, the pump rod 204 moves within the pump cylinder 202 (e.g., in or out of the pump cylinder 202) and the pump cylinder 202 rotates about the pivot pin 224 to maintain alignment with the pump rod 204. For example, when the lever 210 is rotated in the first direction 226 (e.g., counterclockwise in the orientation of FIG. 2), the pump rod 204 moves away from the pump cylinder 202 (e.g., upward in the orientation of FIG. 2) and rotates clockwise (e.g., in the orientation of FIG. 2). The pump cylinder 202 rotates about the pivot pin 224 clockwise with the pump rod 204 to maintain alignment with the pump rod 204, and fluid flows into the chamber 206. On the other hand, when the lever 210 is rotated in the second direction 228 (e.g., clockwise in the orientation of FIG. 2), the pump rod 204 moves toward the pump cylinder 202 (e.g., downward in the orientation of FIG. 2) and rotates counterclockwise (e.g., in the orientation of FIG. 2). The pump cylinder 202 rotates about the pivot pin 224 counterclockwise with the pump rod 204 to maintain alignment as fluid is expelled from the chamber 206.

The rotation of the pump cylinder 202 allows the pump rod 204 to move within the pump cylinder 202 without creating a side load, such as the side load 130 shown in connection with FIG. 1. For example, as the lever 210 moves in the first direction 226, the first joint 212 moves to the right (e.g., in the orientation of FIG. 2), and the pump cylinder 202 rotates about the pivot pin 224 to maintain a concentricity between the pump cylinder 202 and the pump rod 204 (e.g., the pump cylinder 202 maintains alignment with the pump rod 204). In such an example, the pump cylinder 202 and the pump rod 204 are aligned along a central axis 230 (e.g., an axis through the center of the pump rod 204). Because of the rotation of the pump cylinder 202, the movement of the pump rod 204 is maintained along this central axis 230. Thus, a force exerted on the pump rod 204 at the first joint 212 (e.g., by an operator rotating the pump handle 229) is exerted along the central axis 230, and there is no component of force along the lever 210, such as the force component 128 present during operation of the known hydraulic override pump 100 of FIG. 1.

Further, because the force is exerted along the central axis 230, and in line with the motion of the pump rod 204, friction between the pump rod 204 and the pump cylinder 202 is reduced. For example, there is substantially no friction created between the pump rod 204 and the pump cylinder 202 during movement of the pump rod 204 due to the rotation of the pump cylinder 202. For example, prevention of the side load 130 that is exerted on the pump rod 104 of FIG. 1, an amount of friction between the pump rod and the pump cylinder is substantially reduced and/or eliminated. The pump cylinder 202 further includes an example seal 232, located at an end of the pump cylinder 202 opposite the pivot pin 224, to prevent fluid leakage from the pump cylinder 202. As the pump rod 204 moves in and out of the pump cylinder 202, friction is created between the pump rod 204 and the seal 232. However, the friction created at the interface between the pump rod 204 and the seal 232 is negligible compared to the reduction in friction of the hydraulic override pump 200 (e.g., the friction between the pump rod 204 and the seal 232 is negligible compared to the friction that exists between the pump cylinder 102 and the pump rod 104 of the known hydraulic override pump 100 of FIG. 1).

Throughout the movement of the lever 210, the pump rod 204 and pump cylinder 202 rotate within an example angular range 234. In some examples, the angular range 234 is between a vertical position of the pump cylinder 202 and a position of the pump cylinder 202 closer to the support 220. In some examples, the angular range 234 is defined between a position of the pump cylinder 202 when the lever 210 is horizontal (e.g., in the orientation of FIG. 2) and a position where the lever 210 is at the greatest angle possible with respect to a horizontal plane (e.g., an angle close to 90° with respect to a horizontal plane). In some examples, the angular range 234 is based on the joint (e.g., the second joint 214, the third joint 216, or the fourth joint 218) at which the lever 210 rotatably couples to the support 220. For example, when the lever 210 is rotatably coupled to the support 220 at the second joint 214, the angular range 234 will be less than when the lever 210 is coupled to the support 220 at the fourth joint 218 (e.g., because a distance between the first joint 212 and the second joint 214 along a length of the lever 210 is less than a distance between the first joint 212 and the fourth joint 218 along the length of the lever 210). In some examples, the angular range 234 is increased by coupling the lever 210 to the support 220 at the third joint 216 or the fourth joint 218 instead of the second joint 214.

Figure 4:
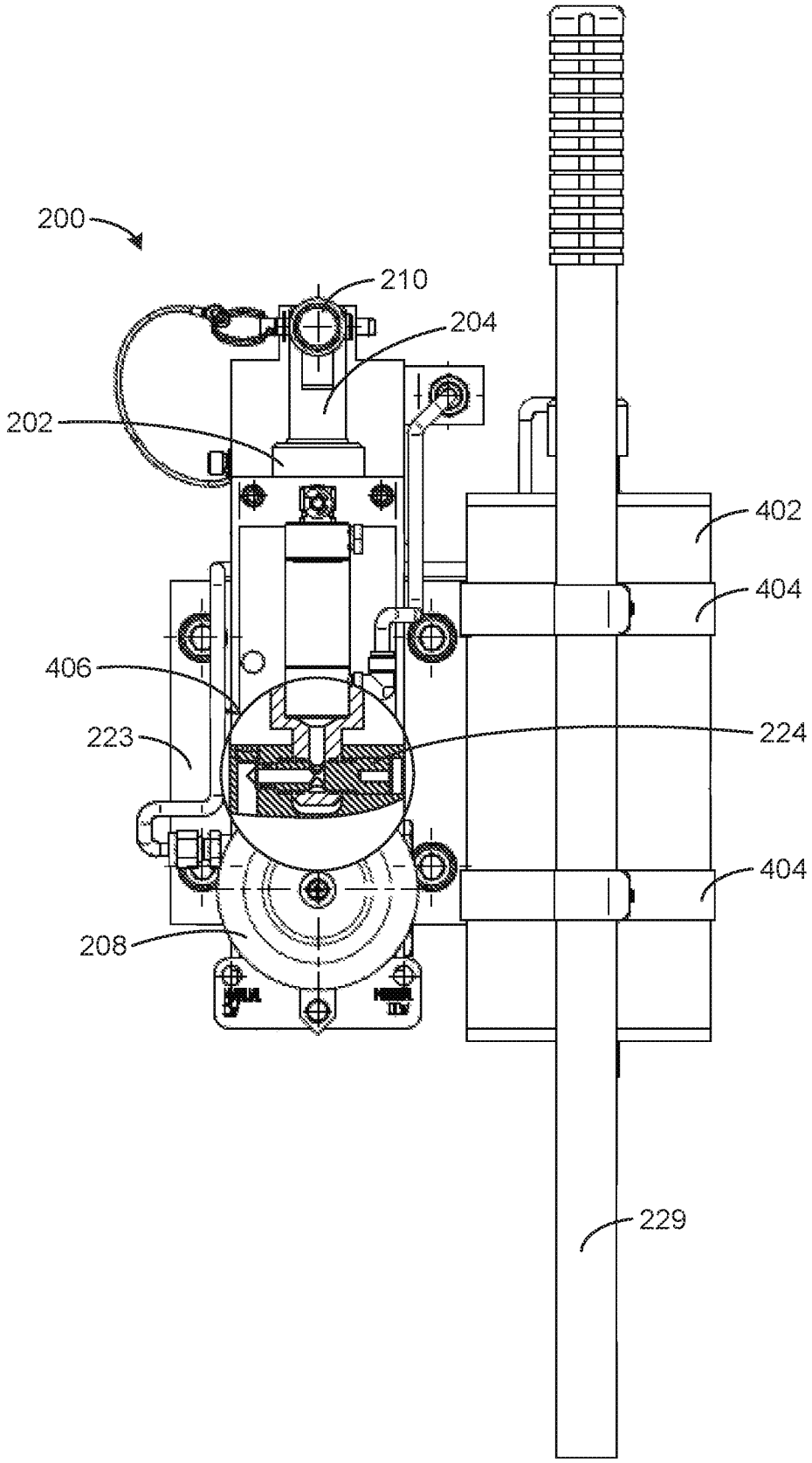
FIG. 4 is a side view of the example hydraulic manual override pump of FIG. 2 fluidly coupled to an example reservoir.

In addition to facilitating rotation of the pump cylinder 202, the pivot pin 224 further includes a fluid channel (shown in connection with FIG. 5) to facilitate fluid communication between the chamber 206 of the pump cylinder 202 and the fluid control valve 208 and/or an example fluid reservoir (shown in connection with FIG. 4). For example, as the pump rod 204 moves away from the pivot pin 224 (e.g., upward in the orientation of FIG. 2), the chamber 206 fills with fluid. The fluid flows from the fluid reservoir through an example manifold 236 to the pivot pin 224. The fluid then flows through the fluid channel of the pivot pin 224 and into the chamber 206. The flow of fluid is initiated by backpressure created in the chamber 206 by the pump rod 204 when it moves away from the pivot pin 224 and increases the volume in the chamber 206. On the other hand, when the pump rod 204 moves back toward the pivot pin 224, the fluid in the chamber 206 is pushed back through the fluid channel of the pivot pin 224 and out through the manifold 236. For example, the fluid can flow through a fluid channel of the manifold 236 to the fluid control valve 208 different than the channel of the manifold 236 that fluidly couples to the reservoir. The pivot pin 224 is discussed in further detail in connection with FIG. 5.

Figure 3:
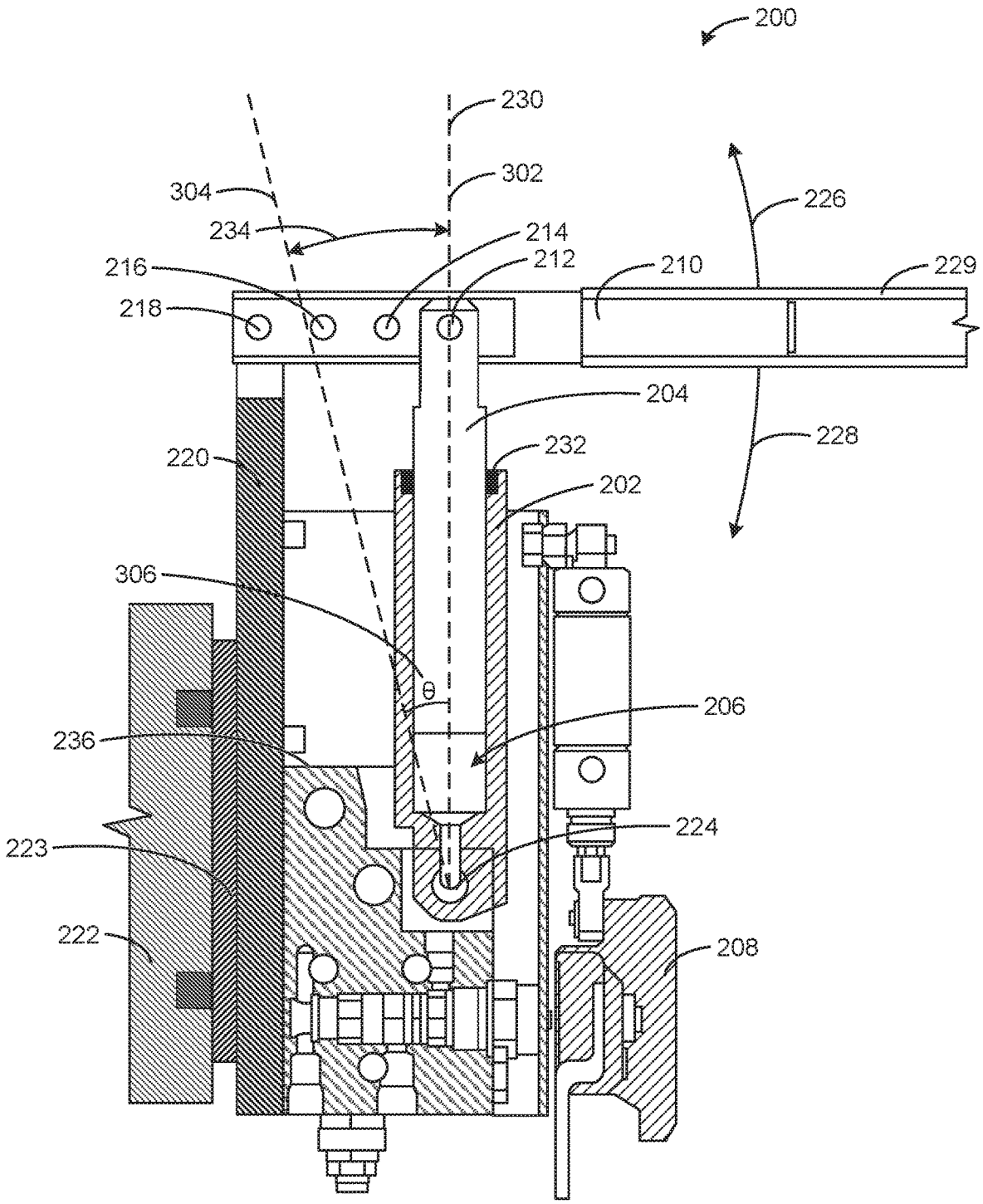
FIG. 3 is a cross-sectional view of the example hydraulic manual override pump of FIG. 2 in a second configuration.

FIG. 3 is a cross-sectional view of the example hydraulic manual override pump 200 of FIG. 2 in a second configuration. In the second configuration illustrated in FIG. 3, the pump rod 204 is coupled to the example first joint 212 of the lever 210, and the lever 210 is coupled to the support 220 at the fourth joint 218. The lever 210 has a horizontal orientation (e.g., in the orientation of FIG. 3), and the pump rod 204 is vertical (e.g., in the orientation of FIG. 3).

Depending on the application for which the hydraulic manual override pump 200 is implemented, the lever 210 can be coupled to the support 220 at any of the second joint 214, the third joint 216, or the fourth joint 218. For example, the fourth joint 218 can be used in applications where low pressures are used (e.g., 300 psi). For use at higher pressures (e.g., 3000 psi), the second joint 214 can be used. One of the joints 214-218 is selected to be coupled to the support 220 to create a longer or shorter distance between the joint that couples the lever 210 to the pump rod 204 and the joint that couples the lever 210 to the support 220. When this distance is small (e.g., the lever 210 couples to the support 220 at the second joint 214), a resistive force exerted by the pump rod 204 on the lever 210 is more easily overcome (e.g., by an operator exerting an input force at the end of the lever 210). Thus, in higher pressure applications, the first configuration (e.g., as shown in FIG. 2) is used to overcome the higher resistance of the pump rod 204 (e.g., due to increased pressure).

On the other hand, when the distance is large (e.g., the lever 210 couples to the support 220 at the fourth joint 218), the resistive force exerted by the pump rod 204 on the lever 210 is more difficult to overcome (e.g., due to a longer moment arm between the first joint 212 and the fourth joint 218). Thus, in lower pressure applications, the fourth joint 218 can be used (e.g., because the force exerted by the pump rod 204 on the lever 210 is lower). Further, in some examples, when the operator desires to operate the hydraulic manual override pump 200 faster (e.g., pump more fluid), the fourth joint 218 (e.g., as shown in the second configuration of FIG. 3) can be used (e.g., due to a longer stroke of the lever 210). In such examples, the input force applied by the operator (e.g., at an end of the pump handle 229) increases due to the longer distance between the fourth joint 218 and the first joint 212.

When the lever 210 is rotated in the first direction 226 (e.g., by an operator), the pump rod 204 moves away from the pump cylinder 202 (e.g., moves out of the pump cylinder 202). The volume of the chamber 206 then increases, creating more space in the cavity for fluid to flow into through the pivot pin 224. Further, as the lever 210 is rotated in the first direction 226, the pump cylinder 202 rotates toward the support 220 (e.g., to the left in the orientation of FIG. 3). In some examples, the lever 210 can be rotated until it is generally vertical in the orientation of FIG. 3. For example, the lever 210 can be rotated until the four joints 212-218 are oriented vertically (e.g., the first joint 212 is vertically above or below the fourth joint 218 in the orientation of FIG. 3). In some examples, the rotation of the lever 210 is limited by the pump rod 204. For example, rotation of the lever 210 is stopped when the pump rod 204 has moved a predetermined distance within the pump cylinder 202 (e.g., to prevent the pump rod 204 from exiting completely from the pump cylinder 202).

The pump cylinder 202 rotates about the pivot pin 224 through the example angular range 234. In some examples, the angular range 234 is determined by the lever 210. For example, the angular range 234 of the pump cylinder 202 includes a first angular boundary 302 where the lever 210 is horizontal and where the pump cylinder is vertical (e.g., the orientation shown in FIG. 3). The angular range 234 further includes a second angular boundary 304 at which the lever 210 is vertical and the pump cylinder is at an example maximum pump cylinder angle 306, measured from a vertical plane (e.g., the first angular boundary 302). In some examples, the maximum pump cylinder angle 306 is less than 90° because the lever 210 cannot be rotated until it is vertical (e.g., due to limitations of the movement of the pump rod 204 within the pump cylinder 202), and the angular range 234 is therefore also less than 90°. As the pump cylinder 202 rotates from the first angular boundary 302 to the second angular boundary 304 due to rotation of the lever 210 in the first direction 226, the pump rod 204 moves further from the pump cylinder 202 (e.g., extends further out of the pump cylinder 202). In such an example, the chamber 206 fills with fluid as the lever 210 is rotated in the first direction 226. Alternatively, when the pump cylinder 202 rotates from the second angular boundary 304 to the first angular boundary 302 due to rotation of the lever 210 in the second direction 228, the pump rod 204 moves toward the pump cylinder 202, and the fluid exits the chamber 206.

When the lever 210 is rotated in the second direction 228 from the horizontal position shown in FIG. 3, the pump cylinder 202 again moves from the first angular boundary 302 of the angular range 234 toward the second angular boundary 304. In such an example, the pump rod 204 moves toward the pump cylinder 202, and the chamber 206 decreases in size (e.g., decreases in volume). Fluid in the chamber 206 thus exits the chamber 206 and flows into the pivot pin 224. When the lever 210 is rotated in the first direction 226 back toward the horizontal position (e.g., shown in FIG. 3), the pump rod 204 moves away from the pump cylinder 202, and fluid flows into the chamber 206. In some such examples, the pump cylinder 202 rotates from the second angular boundary 304 to the first angular boundary 302. In some examples, rotation of the lever 210 in the second direction 228 does not cause the pump cylinder 202 to reach the second angular boundary 304 because components of the hydraulic manual override pump 200 prevent further rotation of the pump cylinder 202 (e.g., the pump cylinder 202 comes in contact with the support 220 and/or the housing 222).

FIG. 4 is a side view of the example hydraulic manual override pump 200 of FIG. 2 fluidly coupled to an example reservoir 402. In the illustrated example of FIG. 4, the hydraulic manual override pump 200 is fluidly coupled to the example reservoir 402. In operation, the reservoir 402 supplies fluid to the hydraulic manual override pump 200. The reservoir 402 is positioned on the example mounting bracket 223 of FIG. 2. In some examples, the example pump handle 229 of FIG. 2 is coupled to example clamps 404 via the mounting bracket 223. In some examples, the mounting bracket 223 is used to mount the hydraulic manual override pump 200 and the reservoir 402 to the example housing 222 of FIG. 2.

In some examples, the pump rod 204 moves up and down (e.g., in the orientation of FIG. 4) as the lever 210 rotates. When the pump rod 204 moves upward in the orientation of FIG. 4 (e.g., due to rotation of the lever 210), pressure created by movement of the pump rod 204 pulls fluid from the reservoir 402 through an example pivot pin assembly 406 (e.g., discussed further in connection with FIG. 5) and into the chamber 206 (not shown) of the pump cylinder 202. As the pump rod 204 moves downward in the orientation of FIG. 4, the fluid in the chamber 206 exits the pump cylinder 202 and flows through the pivot pin assembly 406 to the fluid control valve 208.

In some examples, the pump handle 229 is decoupled from the clamps 404 to be used as described in connection with FIG. 2. For example, the pump handle 229 can couple to the lever 210 (e.g., removably couple to the lever 210, slidably engage the lever 210, etc.) to increase a length of a lever arm of the lever 210. In such examples, an operator rotating the pump handle 229 increases an input force due to the longer lever arm.

Figure 5:
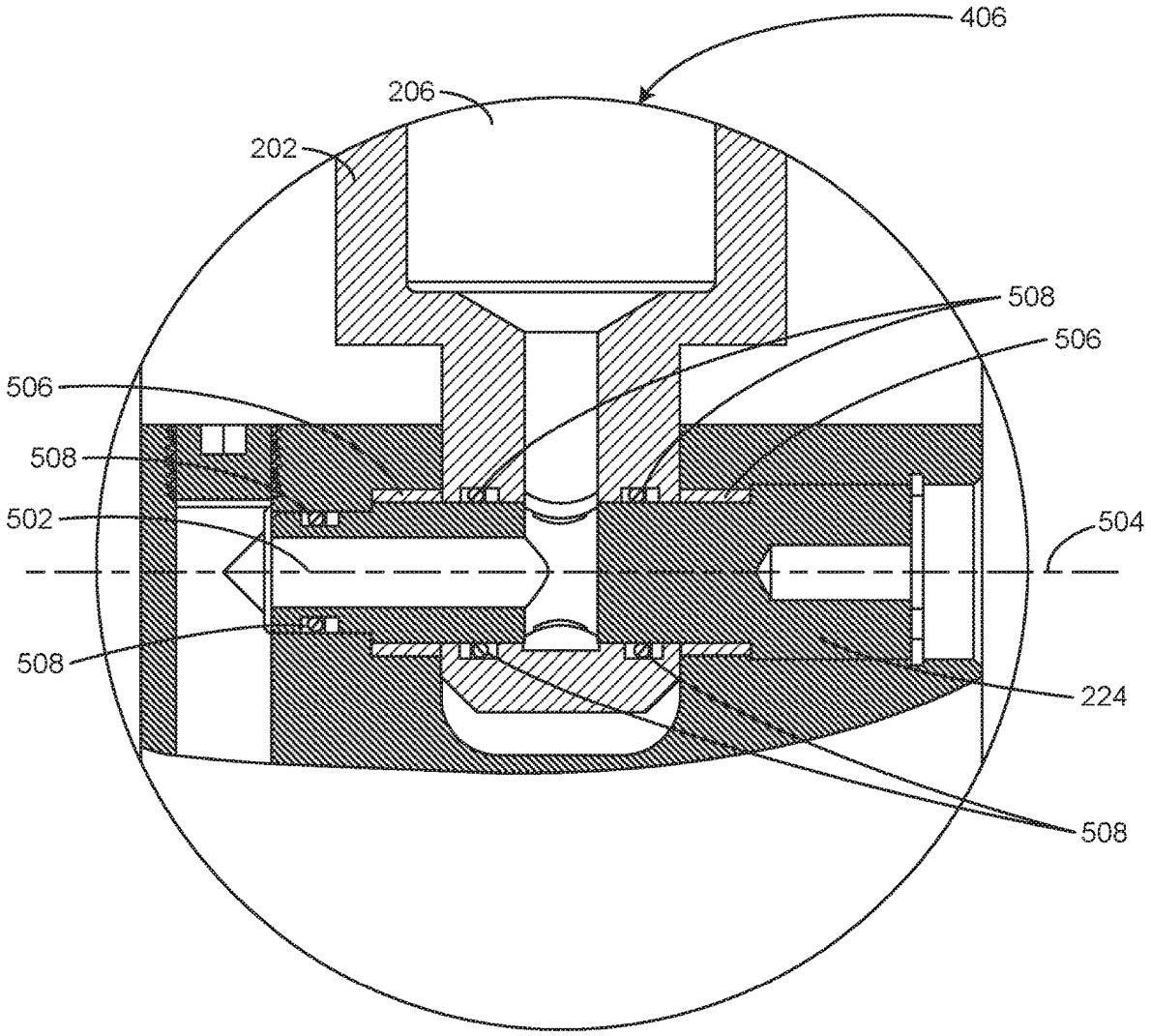
FIG. 5 is a cross-sectional view of the example pivot pin assembly of FIG. 4.

FIG. 5 is a cross-sectional view of the example pivot pin assembly 406 of FIG. 4. The pivot pin assembly 406 includes the example pivot pin 224 of FIG. 2 operatively coupled to the example pump cylinder 202. The illustrated example of FIG. 5 further includes the example chamber 206 within the example pump cylinder 202 of FIG. 2. The pivot pin 224 of the illustrated example includes a fluid channel 502 that is fluidly coupled to the chamber 206. In some examples, fluid flows out of the chamber 206 (e.g., when the pump rod 204 of FIG. 2 moves toward the pivot pin 224, decreasing the volume of the chamber 206 and expelling the fluid) and into the fluid channel 502. In such an example, the fluid channel 502 transfers the fluid to the manifold 236 of FIG. 2 where it is routed to the fluid control valve 208 of FIG. 2. Additionally, in some examples, fluid flows to the fluid channel 502 through the manifold 236 and into the chamber 206 of the pump cylinder 202 (e.g., when the pump rod 204 moves away from the pivot pin 224, increasing the volume of the chamber 206).

As discussed in connection with FIGS. 2-4, the pump cylinder 202 rotates about the pivot pin assembly 406 during operation of the example hydraulic manual override pump 200 to prevent a side load from acting on the pump cylinder 202. The pivot pin 224 of the illustrated example rotates about a pivot pin axis 504 as the pump cylinder 202 rotates. Because the pivot pin 224 rotates with the pump cylinder 202, the fluid coupling of the fluid channel 502 and the chamber 206 is continuous throughout operation of the hydraulic manual override pump 200.

The pivot pin assembly 406 of the illustrated example includes bearings 506 to enable rotation of the pivot pin 224 about the pivot pin axis 504 with reduced friction. For example, the bearings 506 reduce friction as the pivot pin 224 rotates about the pivot pin axis 504. In some examples, the bearings 506 are pin bearings (e.g., needle roller bearings). Additionally or alternatively, the bearings 506 can be any other type of bearing (e.g., spherical roller bearings, gear bearings, etc.). In the illustrated example, seals 508 prevent fluid from leaking between the manifold 236 and the pivot pin 224 as fluid flows between the manifold 236 and the fluid channel 502. The seals 508 further prevent fluid leakage between the pump cylinder 202 and the pivot pin 224 as fluid flows to or from the chamber 206.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

The examples disclosed herein provide a hydraulic manual override pump that reduces and/or prevents a side load exerted on a pump cylinder of the override pump by a pump rod. Because of the reduction and/or prevention of the side load exerted on the pump cylinder, an amount of friction between the pump rod and the pump cylinder is substantially reduced and/or eliminated. The examples disclosed herein allow the pump cylinder to rotate to maintain alignment with the pump rod as the pump rod moves within the pump cylinder. Further, the disclosed examples include a pivot pin to fluidly couple the pump cylinder to a manifold, which pulls fluid from a fluid reservoir and/or provides fluid to a fluid control valve, regardless of the orientation of the pump cylinder (e.g., regardless of the angle of the pump cylinder). For example, the pivot pin continues to facilitate the fluid connection between the pump cylinder and the manifold while the pump cylinder is rotating, preventing the need for a hose connection between the pump cylinder and the manifold.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a pump cylinder rotatable about a first end, the pump cylinder including a second end adjacent a lever, the first end opposite the second end;

a pump rod operatively coupled to the pump cylinder to move relative to the pump cylinder in response to movement of the lever; and a pivot pin operatively coupled to the first end of the pump cylinder to allow rotation of the pump cylinder during movement of the pump rod, wherein the pivot pin is a unitary piece configured to extend through the first end of the pump cylinder, the pivot pin including a first end in connection with a second end and a fluidic channel defined between the first end and the second end, the first end external to the pump cylinder on a first side of the pump cylinder, the second end external to the pump cylinder on a second side of the pump cylinder opposite the first side.

2. The apparatus of claim 1, wherein an end of the pump rod is configured to move toward the first end of the pump cylinder when the lever pivots in a first direction, the end of the pump rod configured to move toward the second end of the pump cylinder when the lever pivots in a second direction opposite the first direction, wherein fluid passes through the fluidic channel into the pump cylinder in response to the end of the pump rod moving toward the second end of the pump cylinder.

3. An apparatus comprising:

a pump cylinder rotatable about a first end, the pump cylinder including a second end adjacent a lever, the first end opposite the second end;

a pump rod operatively coupled to the pump cylinder to move relative to the pump cylinder in response to movement of the lever; and a pivot pin operatively coupled to the first end of the pump cylinder to allow rotation of the pump cylinder during movement of the pump rod, wherein the pivot pin is a unitary piece configured to extend through the first end of the pump cylinder, the pivot pin including a first end in connection with a second end and a fluidic channel defined between the first end and the second end, the first end external to the pump cylinder on a first side of the pump cylinder, the second end external to the pump cylinder on a second side of the pump cylinder opposite the first side, an end of the pump rod configured to move toward the first end of the pump cylinder when the lever is operated in a first direction, the end of the pump rod configured to move toward the second end of the pump cylinder when the lever is operated in a second direction opposite the first direction, wherein fluid passes through the fluidic channel into the pump cylinder in response to the end of the pump rod moving toward the second end of the pump cylinder.

4. The apparatus of claim 3, further including the lever to rotate about a first joint when a force is received at a first end of the lever, a position of the first joint variable along a length of the lever.

5. The apparatus of claim 4, wherein the pump cylinder rotates within an angular range, the angular range based on the position of the first joint.

6. The apparatus of claim 5, wherein the angular range increases when the first joint is located at a position further along the length of the lever toward a second end of the lever from a second joint, the pump rod and the lever coupled at the second joint, the second end of the lever opposite the first end of the lever.

7. The apparatus of claim 4, wherein, when the lever rotates in the second direction from a first position to a second position further away from the pump cylinder than the first position, the pump cylinder rotates in at least a first rotational direction.

8. The apparatus of claim 7, wherein, when the lever rotates in the first direction from the second position to the first position, the pump cylinder rotates in at least a second rotational direction.

9. The apparatus of claim 3, wherein a manifold operatively coupled to the pivot pin provides a fluid connection between the pump cylinder and a fluid reservoir.

10. The apparatus of claim 9, wherein the manifold provides a fluid connection between the pump cylinder and a fluid control valve.

11. An apparatus comprising:

a lever rotatably mounted to a support;

a pump cylinder rotatable about a first end of the pump cylinder, the pump cylinder including a second end adjacent the lever, the first end opposite the second end;

a pivot pin operatively coupled to the first end of the pump cylinder, wherein the pivot pin is a unitary piece configured to extend through the first end of the pump cylinder, the pivot pin including a first end in connection with a second end and a fluidic channel defined between the first end and the second end, the first end external to the pump cylinder on a first side of the pump cylinder, the second end external to the pump cylinder on a second side of the pump cylinder opposite the first side; and a pump rod operatively coupled to the lever to move within the pump cylinder based on rotation of the lever, wherein the pump cylinder rotates about the pivot pin when the pump rod moves within the pump cylinder, an end of the pump rod configured to move toward the first end of the pump cylinder when the lever is operated in a first direction, the end of the pump rod configured to move toward the second end of the pump cylinder when the lever is operated in a second direction opposite the first direction, wherein fluid passes through the fluidic channel into the pump cylinder in response to the end of the pump rod moving toward the second end of the pump cylinder.

12. The apparatus of claim 11, wherein a manifold operatively coupled to the pivot pin provides a fluid connection between the pump cylinder and a fluid reservoir.

13. The apparatus of claim 12, wherein the manifold further provides a fluid connection between the pump cylinder and a fluid control valve.

14. The apparatus of claim 12, wherein the fluidic channel fluidly couples the pump cylinder to the manifold.

15. The apparatus of claim 11, wherein the pump cylinder includes a seal disposed at the second end to prevent fluid leakage when the pump rod moves within the pump cylinder.

16. The apparatus of claim 11, wherein, when the lever is rotated in the second direction from a first position to a second position further away from the pump cylinder than the first position, the pump rod and the pump cylinder rotates in at least a first rotational direction.

17. The apparatus of claim 16, wherein, when the lever is rotated in the first direction from the second position to the first position, the pump cylinder rotates in at least a second rotational direction.

18. The apparatus of claim 11, wherein the lever is rotatably mounted to the support at a joint, the joint disposed at a variable position along a length of the lever.

19. The apparatus of claim 18, wherein the pump cylinder rotates through an angular range, the angular range based on the position of the joint along the length of the lever.

20. The apparatus of claim 11, wherein the first end of the pivot pin has a first diameter and the second end of the pivot pin has a second diameter, the first diameter different than the second diameter, the first end of the pivot pin including an annular shoulder to receive a bearing.

* * * * *